United States Patent [19]

Yamai et al.

[11] Patent Number: 4,530,041

[45] Date of Patent: Jul. 16, 1985

[54] SIGNAL LAMP WITH A MOVABLE SLIT PLATE

[75] Inventors: Yoshihiro Yamai; Hideo Hamamoto; Masami Nishibe, all of Toyota, Japan

[73] Assignee: Toyota Jidosha Kabushiki Kaisha, Toyota, Japan

[21] Appl. No.: 573,657

[22] Filed: Jan. 25, 1984

[30] Foreign Application Priority Data

Jan. 26, 1983 [JP] Japan ..... 58-9384[U]

[51] Int. Cl.[3] ..... F21V 9/00

[52] U.S. Cl. ..... 362/268; 362/230; 362/231; 362/232; 362/233; 362/280; 362/293; 362/295; 362/311; 362/321; 362/331; 362/332; 362/339; 362/351; 362/360; 362/455; 340/84

[58] Field of Search ..... 340/110, 111, 112, 94, 340/66, 67, 84; 350/311, 315; 362/293, 280, 332, 321, 279, 290, 306, 354, 230, 231, 232, 233, 268, 295, 311, 331, 339, 351, 360, 455

[56] References Cited

U.S. PATENT DOCUMENTS 1,247,273 11/1917 Hochstetter ..... 350/315
2,104,911 1/1938 Snyder ..... 362/280 X

FOREIGN PATENT DOCUMENTS 1338557 11/1973 United Kingdom ..... 350/315

*Primary Examiner*—Stephen J. Lechert, Jr.
*Attorney, Agent, or Firm*—Finnegan, Henderson, Farabow, Garrett and Dunner

[57] ABSTRACT

A signal lamp having in its housing with an opening, a bulb, an optical elements installed in the housing for converting the light of the bulb into parallel rays of light, a colored lens being colored differently in plurality of regularly disposed patterns, a slit plate installed slidably and provided with portions pervious to light corresponding to said pattern in shape and a solenoid, by which the slit plate is shifted and the radiated light is converted in its color.

1 Claim, 3 Drawing Figures

SIGNAL LAMP WITH A MOVABLE SLIT PLATE

BACKGROUND OF THE INVENTION

This invention relates to a signal lamp assembly with a slit plate for radiating colored lights. Conventionally in signal lamps used in vehicles or in beacons, colored illumination is commonly required. In the conventional construction of such lamps, for the purpose of obtaining a desired colored illumination it is necessary to form in one signal lamp assembly a plurality of lamp units each one of which consists of one housing, one bulb and one colored lens, and in the actual use thereof it is done by lighting one bulb which belongs to the desired colored lens.

From these conventional signal lamps, one typical illustration having two different colored lenses will be shown in FIG. 1.

In FIG. 1 two cubicles are formed by partioning a housing 1 into two parts having inner lenses 2*a*,2*b* respectively fixed in the openings of the cubicles. A pair of outer lenses 3*a*, 3*b*, positioned adjacent inner lenses 2*a* and 2*b* have different colors, such as red and amber. However, the manufacturing considerations are complicated because housing 1 is partitioned into a plurality of cubicles and only small bulbs 4*a*,4*b* usable therein. Moreover, because the inner lenses 2*a*,2*b*, outer lenses 3*a*,3*b* and bulbs 4*a*,4*b* are required for each colored light, power consumption as well as production costs increase.

Since bulbs of conventional signal lamps especially for use in automobiles have to be repaired so often, a large extent of space is occupied by the signal lamp, particularly in view of the number of colors required. This is a big drawback as far as car design is concerned.

SUMMARY OF THE INVENTION

According to the present invention, one of the plurality of colored illuminations is obtained selectively from merely one lens installed in a housing containing merely one bulb. More specifically, in the present invention, a signal lamp contains a bulb in its housing and an opening for receiving an optical element in such a manner as to convert the light of the bulb into parallel rays of light. The signal lamp further comprises a lens provided in the opening, the lens being colored differently in plurality of patterns, a slit plate installed slidably and provided with portions pervious to light corresponding to said pattern in shape and arranged along with or in contact with either surface of the colored lens and solenoid means for positioning the slit plate in such a manner as to coincide with the portions pervious to light to one of the patterns colored in one tint to be required.

An object of the present invention is to provide a signal lamp with a slit plate, wherein the colored illumination to be desired will come out from one outer lens of the signal lamp.

To achieve the object listed above for the present invention, the colored lens of a signal lamp for example is tinted differently in every repeated pattern and provided on one side of the lens. The slit plate is provided in the opening in such a manner as to be slidably positioned by a solenoid along with or in contact with the surface of the colored lens and includes has portions pervious to light corresponding in shape to the colored pattern. The slit plate is provided with a resilient means which is hung between the slit plate and the housing and biases the plate to the proper position where portions pervious to light coincide with one of the colored patterns and when the power is supplied to the solenoid. The slit plate is repositioned against biasing force of the resilient means to coincide with another pattern thereby passing the light through it and radiating the differently colored light from the outer lens.

BRIEF DESCRIPTION OF THE DRAWINGS

An embodiment of the present invention will now be described by way of example and with reference to the accompanying drawings, in which.

DESCRIPTION OF THE PREFERRED EMBODIMENTS

Figure 1:
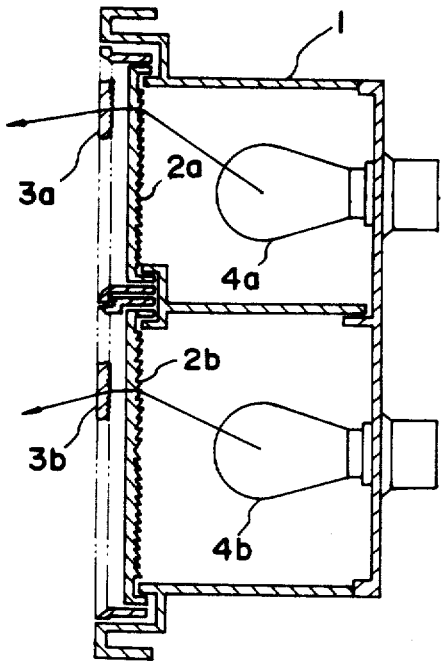
FIG. 1 (PRIOR ART)
FIG. 1 is a cross-sectional view illustrating the construction of a conventional lamp.

Referring now to the drawings, wherein like reference characters designate like or corresponding parts throughout the several views, FIG. 1 shows a conventional lamp.

Figure 2:
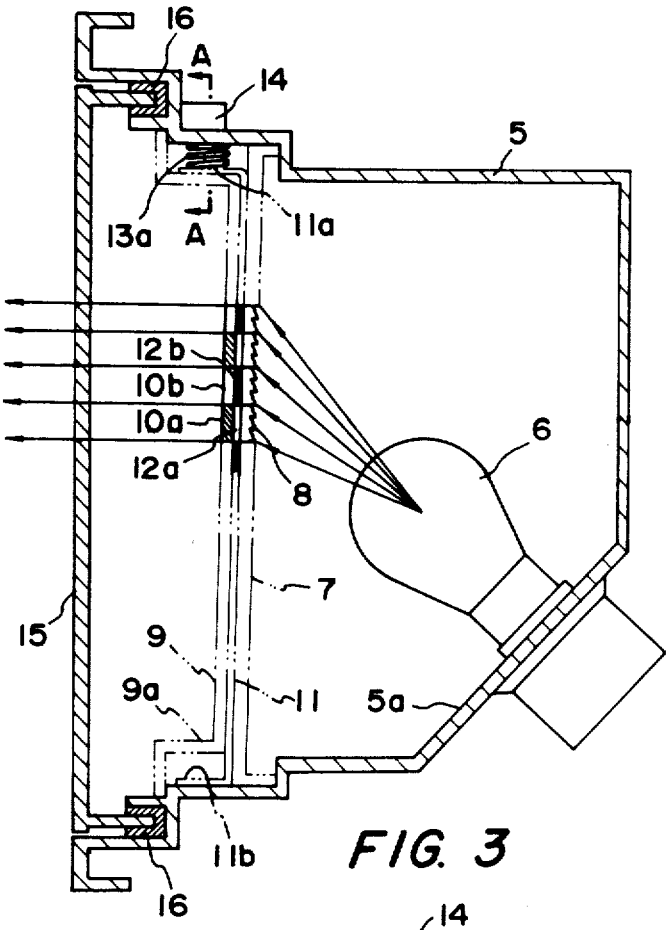
FIG. 2 is a cross-sectional view illustrating a preferred embodiment of the present invention.

Referring now to FIG. 2 shown in cross-section, a preferred embodiment of the present invention will be described. Numeral 5 indicates housing for an automobile tail lamp with an opening, wherein only one bulb 6 is installed in an upwardly inclined surface 5*a* on the bottom side of the housing 5. An inner lens 7 made of acrylic resin is used as an optical element for converting the light of the bulb into parallel rays of light and is fixed in the opening of the housing 5. Inner lens 7, which is called a frenel lens, contains a number of prisms 8 on the side facing bulb 6, so that the light radiated from the bulb 6 may be emitted in the form of parallel rays of light from opposite side of the inner lens. In an opening of the housing 5, there are also fixed colored lenses 9 by means of high frequency welding at spaces, each being equivalent to the thickness of a slit-plate 11 which will be described later. The colored lens 9 consists of several lenses colored in two tints, namely, lenses colored in red 10*a* and amber 10*b* and alternately formed in the vertical direction. The width of the red lens 10*a* and amber lens 10*b* in the vertical direction is equal. Therefore the plurality of red lenses 10*a* form one pattern and the plurality of amber lenses 10*b* form another identical pattern with the former.

Figure 3:
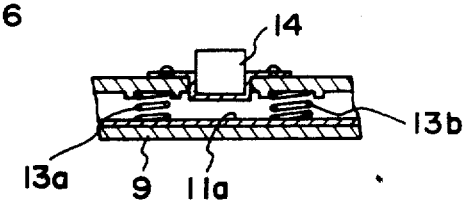
FIG. 3 is a cross-sectional view illustrating the lamp in FIG. 2 along line A—A.

An iron slit-plate 11 is arranged in between the colored lens 9 and the inner lens 7 and made to contact the surfaces of the lenses 9,7, wherein portions 12*a* pervious to light and light-shading portions 12*b* are alternately formed in the vertical direction. The width of the portion 12*a* pervious to light and the light-shading portion 12*b* is made equal to that of the red lens 10*a* and the amber lens 10*b*, respectively that is, these form an identical pattern with one of those of lens 9. The top and bottom ends 11*a*,11*b* of the slit-plate 11 are bent perpendicularly to the colored lens 9 and springs 13*a*,13*b* are installed between the top end of slit-plate 11 and the lower surface of the top portion of housing 5 as shown in FIG. 3. A solenoid 14 is installed at the position corresponding to the intermediate portion between the springs 13*a*,13*b* of the housing 5. The bottom end 11*b* of the slit-plate 11 is made to contact the upper surface of the bottom portion of the housing. A predetermined space at least greater than the width of the portion 12*a* pervious to light is provided in between the bottom end 11*b* of the slit-plate 11 and the lower portion 9*a* of the colored lens 9. An acrylic outer lens 15 is mounted by a sealer 16 in an opening on the opposite side of colored lens 9 from inner lens 7. The the outer lens 15 is constructed in such a manner that a preselected space is provided between outer lens 15 and colored lens 9.

In this embodiment of the present invention, power is supplied to the bulb 6 when the turn signal lamp switch is pressed or when the tail lamp switch is turned on and at the same time it is so arranged that the power is supplied to not only the bulb 6 but also the solenoid 14 when the turn signal lamp switch is pressed. The method of supplying power to the bulb 6 and the solenoid 14 is needless to say not limited to this.

The signal lamp thus constructed operates as follows: if power is supplied, for instance, only to the bulb 6 but not to the solenoid 14, that is, when the tail lamp switch is turned on in this case, only the bulb 6 will be lighted and the solenoid will stand still and not move nor displace. Accordingly, if the light emitted by the bulb 6 is incident on the prism 8 of the inner lens 7, the light will be converted into parallel rays of light, whereby it will forwardly proceed out of the portion 12*a* pervious to light of the slit-plate 11, passing through the outer lens 15 via the red lens 10*a* of the colored lens 9, and then outwardly be radiated therefrom as the light colored in red.

On the other hand, if power is supplied to not only the bulb 6 but also the solenoid 14, that is, when the turn signal lamp switch is pressed in this case, the slit-plate 11 will be actuated by the solenoid 14 and upwardly moved by the width of the red lens 10*a*. As a result, the light emitted by the bulb 6 will be converted into parallel rays of light by the prism 8, whereby it will then proceed out of the portion 12*a* pervious to light of the slit-plate 11, passing through the outer lens 15 via the amber lens 10*b* of the colored lens 9, radiating amber light therefrom.

Although the present invention has been described by reference to the embodiment thereof, it includes the following cases.

1. The slit-plate is installed on the back side of the colored lens in the above embodiment. However, the slit-plate may be installed on the front side thereof.
2. The colored lens may be regularly colored in not only two tints but also a plurality of tints, that is, three or more. In this case, the slit-plate should be so arranged that it is movable by stages via the solenoid to make the above described plurality of colors correspond to the regularly colored portions.
3. The colored lens may be regularly colored in a plurality of tints in the horizontal direction. As occasion demands, it may be regularly colored in both the vertical and horizontal directions; in this case, the portions pervious to light of the slit-plate should be regularly arranged so that they correspond to the plurality of tints in both the vertical and horizontal directions.

We claim:

1. A signal lamp comprising a housing having an opening;

a bulb for emitting light mounted within said housing;

an optical element means positioned within said opening for converting light from said bulb into parallel rays;

a plurality of lenses integrally formed into a planar section and rigidly mounted within said opening, the width from the bottom to the top of said planar section being substantially equal, said lenses being individually tinted in red or amber, the colors being alternated along the continuum of said planar section, thereby forming a pattern of colored lenses;

a slit plate slidably positioned within said opening, said plate being mounted between said lenses and said optical element, said plate having light transmitting and shaded portions which are alternately formed in the vertical direction, the width of said light transmitting and shaded portions being equal to said individual lenses;

a resilient means for biasing said plate and enabling light to be transmitted through a selected one of said paths;

a solenoid for positioning said plate against the bias of said resilient means; and switch means for actuating said bulb independently or in combination with said solenoid.

* * * * *